US005752691A

United States Patent [19]

Bashon et al.

[11] Patent Number: 5,752,691

[45] Date of Patent: May 19, 1998

[54] FENCING ANCHOR

[75] Inventors: Robert L. Bashon; George D. Comyford, both of Vale, Oreg.

[73] Assignee: The Pacific Land and Livestock Co., Inc., Vale, Oreg.

[21] Appl. No.: 735,410

[22] Filed: Oct. 22, 1996

[51] Int. Cl.[6] ..... E04H 17/08

[52] U.S. Cl. ..... 256/35; 256/19; 256/1

[58] Field of Search ..... 52/292, 294, 300, 52/301; 256/13.1, 64, 63, 19, 35; 404/6

[56] References Cited

U.S. PATENT DOCUMENTS

| | | | |
|---|---|---|---|
| 71,736 | 12/1867 | Good | 256/19 |
| D. 258,088 | 1/1981 | Koch | D25/38 |
| 817,282 | 4/1906 | Stewart | 256/35 |
| 1,201,772 | 10/1916 | Smith | 256/35 X |
| 2,659,578 | 11/1953 | Clendenin | 256/19 |
| 2,695,159 | 11/1954 | Bridwell | 256/19 |
| 3,991,980 | 11/1976 | Blackburn | 256/45 |
| 4,040,759 | 8/1977 | Skalle | 404/6 |
| 4,059,362 | 11/1977 | Smith | 404/6 |
| 4,348,133 | 9/1982 | Trent et al. | 404/6 |
| 4,637,186 | 1/1987 | Ruigrok | 52/255 |
| 4,685,656 | 8/1987 | Lee et al. | 256/13.1 |
| 4,773,629 | 9/1988 | Yodock | 256/13.1 |
| 4,946,306 | 8/1990 | Yodock | 404/6 |
| 4,954,009 | 9/1990 | Kellison | 404/6 |
| 5,022,781 | 6/1991 | Smith | 256/13.1 X |
| 5,046,884 | 9/1991 | Girotti | 404/6 |
| 5,131,786 | 7/1992 | House et al. | 404/6 |
| 5,134,815 | 8/1992 | Pickett | 52/71 |
| 5,137,391 | 8/1992 | Ballesteros | 404/6 |
| 5,186,438 | 2/1993 | Cross et al. | 256/13.1 |
| 5,244,172 | 9/1993 | Allega | 248/161 |
| 5,286,136 | 2/1994 | Mandish et al. | 404/6 |
| 5,292,467 | 3/1994 | Mandish et al. | 264/112 |
| 5,471,811 | 12/1995 | House et al. | 52/745.1 |

FOREIGN PATENT DOCUMENTS

| | | | |
|---|---|---|---|
| 462818 | 12/1991 | European Pat. Off. | 404/6 |
| 3012681 | 10/1981 | Germany | 256/19 |
| 3014523 | 10/1981 | Germany | 256/19 |
| 1434925 | 5/1976 | United Kingdom | 404/6 |

*Primary Examiner*—Anthony Knight
*Attorney, Agent, or Firm*—Ken J. Pedersen; Barbara S. Pedersen

[57] ABSTRACT

Various embodiments of a fencing anchor are described, each including a heavy block with a substantially curved or slanted bottom surface for resting on uneven ground and for directing force to the bottom end edges of the block. The end edges act as a wedge which bite into the ground, and the broad, curved or slanted bottom surface sits stably on a variety of ground contours. A height-extension may be used to increase the height of the system, without making the anchor significantly more top-heavy.

10 Claims, 5 Drawing Sheets

FENCING ANCHOR

BACKGROUND OF THE INVENTION

1. Field of the Invention

This invention relates to fencing support and anchoring devices. More specifically, this invention relates to anchors for holding fencing tight and secure on land which is not amenable to the digging of holes for traditional fence posts.

2. Related Art

Above-ground supports for fencing have been used as replacements for traditional fence posts imbedded in the ground. Stewart (U.S. Pat. No. 817,282) discloses such a support, referred to as a "composition fence post," having a broad base for setting on the ground and tapered to its upper end. The Stewart "fence post" is preferably cement that is molded in place where it is to be used, so that it will rest more firmly upon the ground.

Koch (U.S. Pat. No. Des. 258,088) discloses a design for a portable concrete fence support. This design is a thin, upstanding plate, with legs protruding from each end of the plate.

SUMMARY OF THE INVENTION

An object of the present invention is to provide a durable, portable fencing anchor which can be used on land which is not appropriate for traditional fence post installation. For example, the fencing anchor is advantageous for range land or forest land that is rocky, shallow-soiled, or sandy, and where fence post hole digging is too difficult or where fence posts installed in holes tend to lean or wash-out. Another object of the present invention is to provide a fencing anchor which can be easily installed, for example, by a helicopter setting it down from above. Thus, the fencing anchor is advantageous in remote or protected land, where traditional fence post holes or the people, equipment, and vehicles required to install them are judged to be too expensive or to do damage to sensitive environments.

The present invention comprises an anchor having a block of durable, heavy material that may be set down on top of land, and which has a concave bottom surface for additional stability on the land. The preferred anchor has a two-plane inwardly slanting bottom surface which creates "biting" end edges and which is less prone than conventional blocks to tipping and breakage. The invention may also comprise connection means for connecting fencing of various types to the block, and a handle or handles for lifting the fencing anchor to new locations.

DESCRIPTION OF THE PREFERRED EMBODIMENTS

Figure 1:
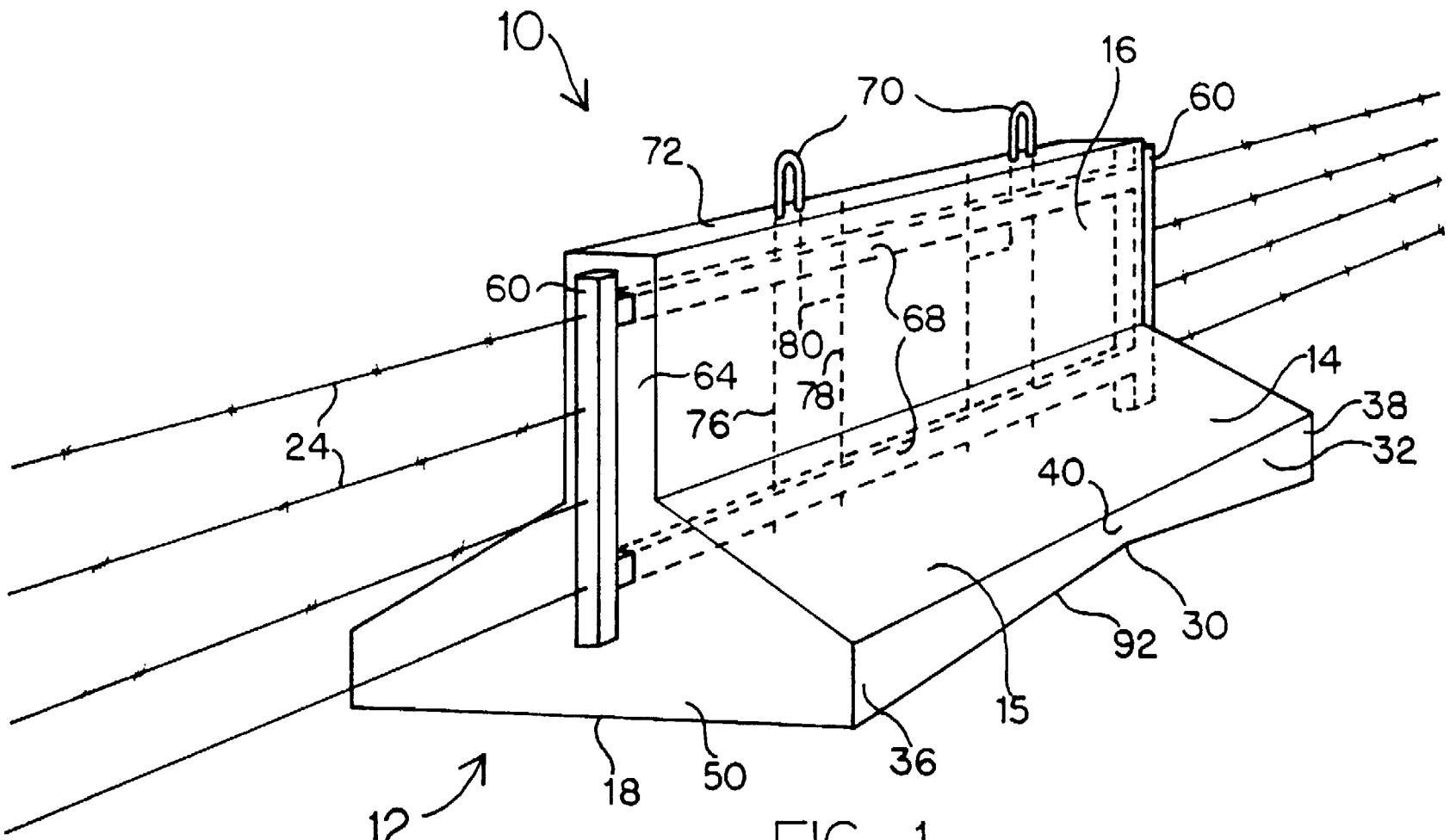
FIG. 1 shows a perspective view of one embodiment of the invention, attached to one example of fencing stringers, barbed wire fencing material.
Figure 2A:
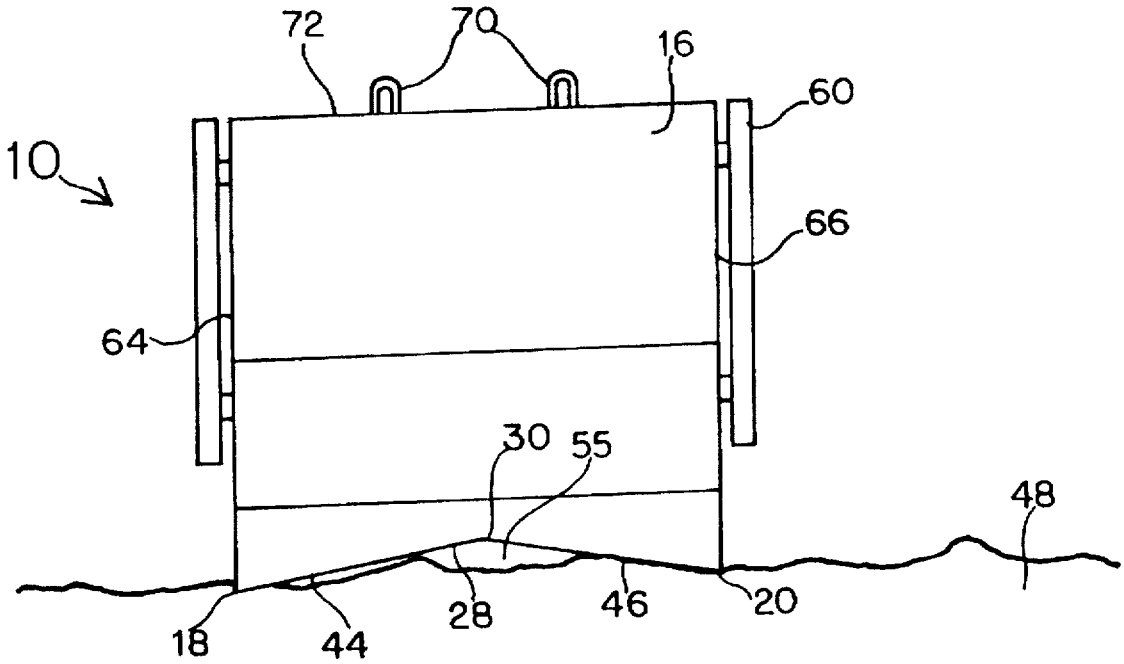
FIG. 2A is a front plan view showing the embodiment of FIG. 1 in one possible relationship to the ground.
Figure 2B:
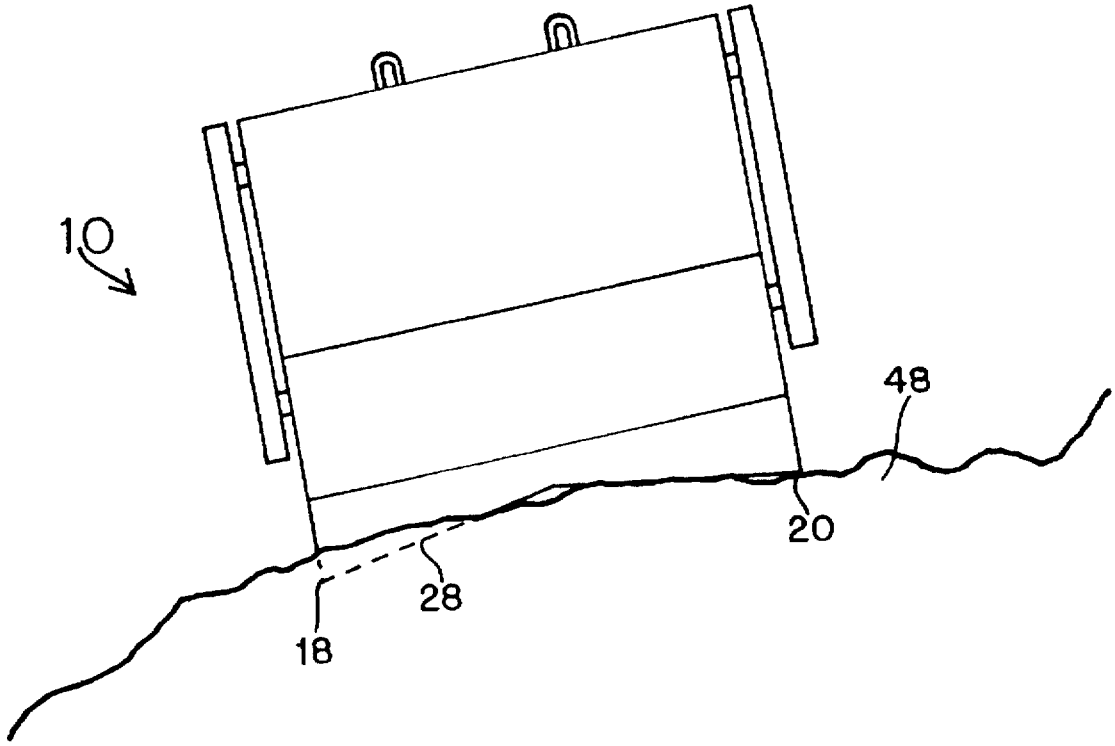
FIG. 2B is a front plan view showing the embodiment of FIG. 1 in another relationship to the ground.
Figure 3:
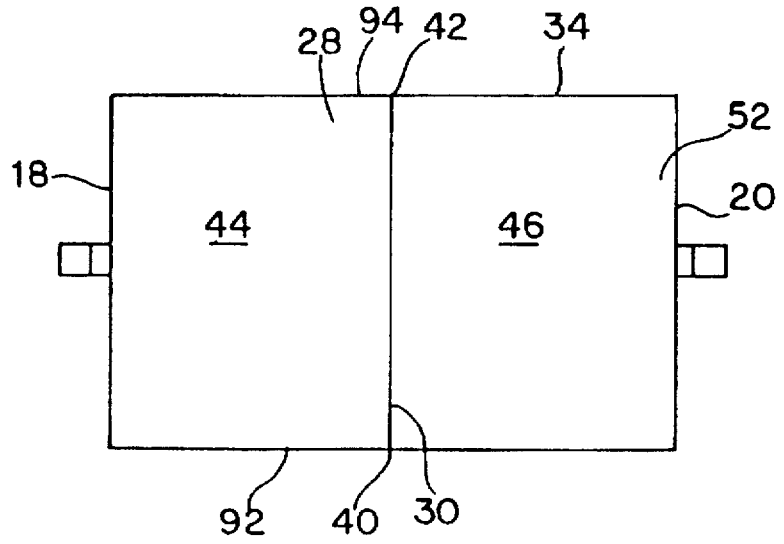
FIG. 3 is a bottom view of the embodiment of FIG. 1.

Referring to FIGS. 1–6, there is shown one, but not the only, embodiment of the invented fencing anchor. The fencing anchor 10 comprises a heavy block 12, preferably, but not necessarily, molded of concrete or similar heavy, weather-resistant composition. The preferred block 12 comprises concrete formed around re-bar and other internal structure used to secure various protruding connection means. Alternatively, the block 12 may be made of several sturdy materials, for example, a strong, lighter material encasing or holding weights in the base of the anchor. The preferred block weighs approximately 2,800 pounds.

The anchor 10 is shaped to include a broad base 14, with dimensions of about 48" long from end to end, by 36" deep from front to back, and about 24" high, where its slanted top surface 15 joins an upstanding post member 16. The post member 16 typically rises about 24" above the base 14, for a total height of about 48". The base 14 stabilizes the anchor 10 on the ground, because of its broad dimensions, its biting edges 18, 20, and its inwardly-slanted bottom surface 28. The post member 16 serves as a generally vertical extension to which fencing materials, such as barbed wire 24 or metal gates 26 are attached.

The shape of the base 14 is particularly effective, in that it is economical to produce and durable but is very stable on the ground, even on very uneven or slanted ground. There are preferably no protruding legs or complicated shapes on the base, so that the base is resistent to breakage. The broad bottom surface 28 slants from its two end edges 18, 20 toward a centerline 30 that is generally parallel to the end edges 18, 20 and preferably approximately half-way between the end edges. The bottom surface 28 slants up from the edge edges 18, 20 at preferably less than about 22° from horizontal, and preferably at about 10°–20°, so that the base front side 32 and back side 34 narrows from about 6 inches high at its ends 36, 38 to about 2 inches at its middle 40, 42. The bottom surface 28, then, is preferably only two planar sections 44, 46 that slant from their respective end edges 18, 20, to meet at an angle at the centerline 30. Optionally, the planar sections 44, 46 may have texture for creating a higher friction surface for interaction with the ground, but for most applications, a molded concrete surface is adequate.

The edges 18, 20 and bottom surface planar sections 44, 46 serve important functions in the stability of the anchor 10. When placed on the ground 48, the acutely-angled edges 18, 20 tend to bite into the ground, when lying either on a generally flat ground or on a slanted ground. The weight of the anchor 10 creates a large force directed to the edges 18, 20, with a large force per square inch exerted by the edges 18, 20 on the ground. Thus, the end edges 18, 20 and the end surface region 50 and bottom surface region 52 that are within about 2–4 inches of the edges 18, 20, create wedges that "bite" into the ground to keep the anchor stable and non-sliding on the ground. The edges 18, 20 may bite into the ground slightly, for example, becoming wedged in gravel or rocks or up to an inch or so into the ground, or, alternatively, may enter softer ground to a greater extent, for example, up to several inches. In soft, sandy, or dusty ground, the edges 18, 20 bite into the ground to the level at which the broad bottom surface 28 rests firmly on the ground and prevents further sinking.

The invented base design increases stability of the anchor 10, without the disadvantages of designs with breakable or difficult-to-mold protruding legs. This design preferably has no parts, such as legs, which can become imbedded so far into soft ground that they impede lifting or removal of the anchor or are damaged when the anchor is moved.

In addition to contributing to the ground-biting feature of the base 14, the slanting base bottom surface 28 contributes to the anchor's stability by creating a bottom shape that is not prone to tipping. The base may rest on uneven, rocky, or slanted ground with the oppositely-facing planar surfaces 44, 46 typically presenting at least part of the bottom surface to rest generally squarely and flatly on the ground, and the slanted surface providing a gap 55 for receiving rocks, clumps of dirt or vegetation without causing tilting or tipping of the anchor 10 (see FIG. 2B). This stability is extremely important for fencing anchor design, because of the tension forces placed on the anchor 10 by wire stringers or other fencing materials.

The post member 16 preferably extends up integrally from the base and generally perpendicularly to the base. The post member 16 is typically a plate shape about 6" thick, but may be other thickness depending on the material used and the connection means chosen for fencing material.

The preferred connection means comprises side-bars 60 fastened generally vertically along each of the two ends 64, 66 of the anchor 10. The side-bars 60 may be 2"×2"×3/16" square metal tubing, for example. The side-bars 60 may be secured into the block 12 by conventional attachment to two generally horizontal cross-brace bars 68 imbedded in the block 12, which extend all the way from end to end through the base 14 and post member 16.

Two handles preferably protrude up from the top surface 72 of the post member 16, for supplying a grip for a helicopter, fork lift, winch, etc. The handles may be made from ½" re-bar, for example, imbedded in the block 12 and extending all the way down to near the bottom surface 28 of the block 12. The preferred handles are loops 70 of rebar, with two parallel rebar extensions 76, 78 and L-shaped tie-in members 80 to further secure the loops 70 to the rebar extensions 78.

A height-extending member 82 optionally may be secured to or into the block 12 for special applications, such as a high fence to protect or manage wildlife. The height-extensioning member 82 may comprise vertical posts 84 and horizontal stringers 86. The ends 88 of the posts may be imbedded in the concrete block 12. The member 82 should be strong but relatively light weight, to keep the center of gravity of the system in the block, or preferably low in the base. The extension member 82, should therefore have a weight less than the block, and preferably less than about 25% of the weight of the block. The member 82 may be 4–8 feet tall and overall heights may reach 8–10 feet, for example, because of the stability of the anchor 10.

Alternatively, other shapes of base 14 may be used, but preferably the base bottom surface is a generally "concave" shape, in that the end edges 18, 20 (at either end of the block's long dimension) are lower than the center area 90 of the bottom surface. This "concave" shape may comprise the inwardly-slanting planar surfaces 44, 46, a gradual upward curving or arched shape 91 (see embodiment 100 in FIG. 5), or even a stepped shape, which creates a bottom surface center that lies on a plane above the plane of the end edges. Preferably the front and back edges 92, 94 also curve or slant upward toward their middles 40, 42 rather than lying in the same plane as the end edges 18, 20.

Figure 4:
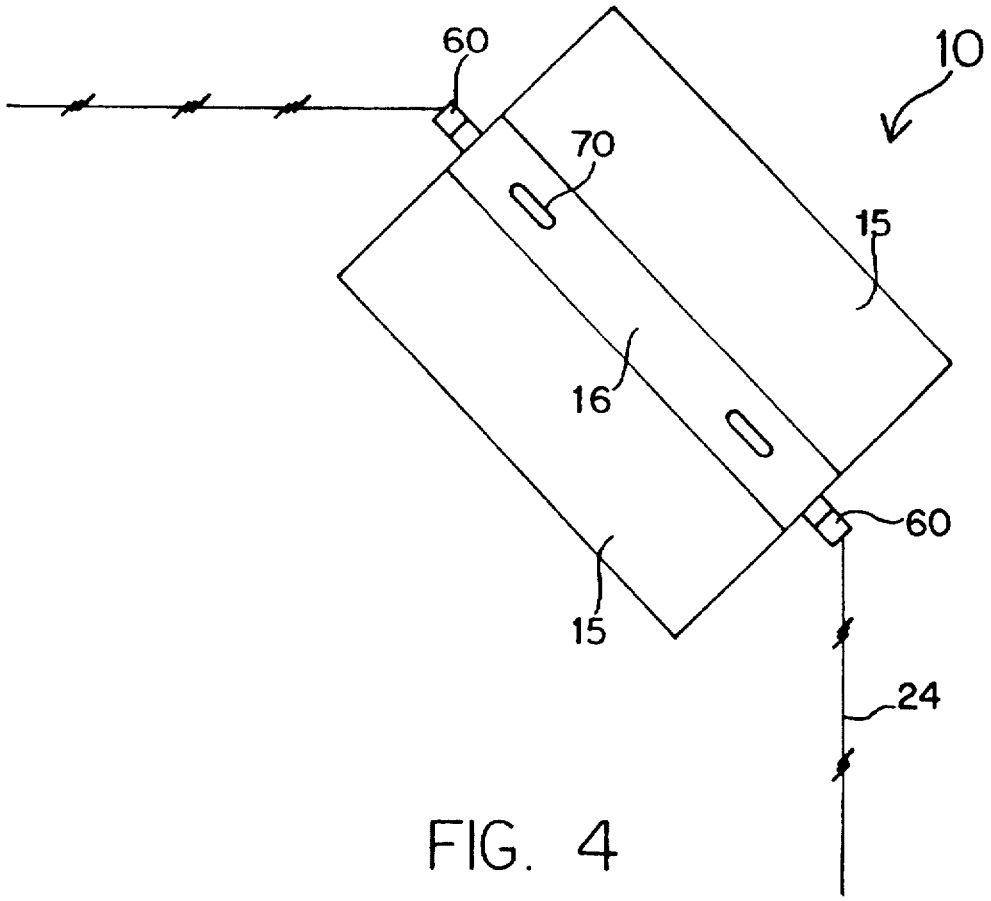
FIG. 4 is a top view showing the embodiment of FIG. 1 in use as a corner anchor.
Figure 5:
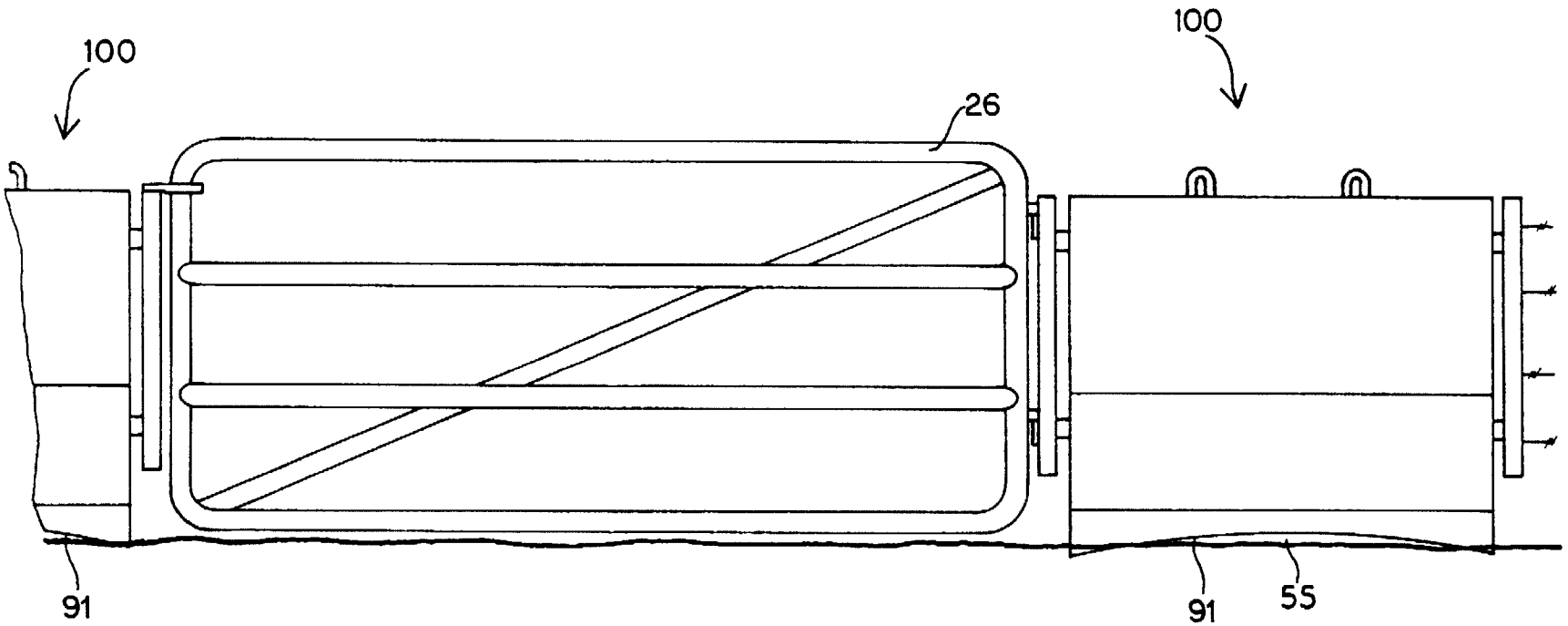
FIG. 5 is a front view of the embodiment of FIG. 1 on both sides of a gate in use as a gate mount.
Figure 6:
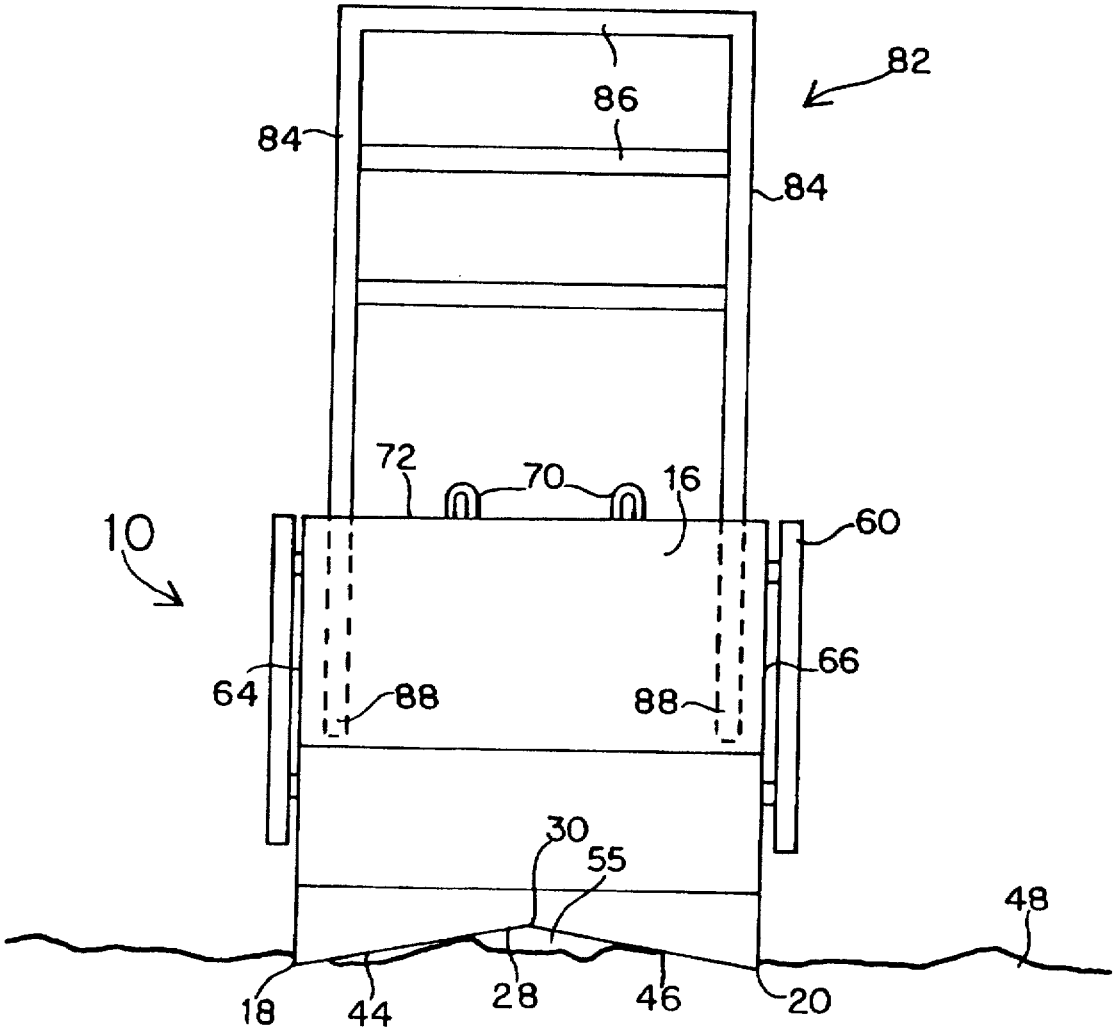
FIG. 6 is a front view of another embodiment of the invention, including a height-extending member.

The anchor 10 may be used in a wide variety of applications, such as the barbed wire support or corner support shown in FIGS. 1 and 4, respectively, or the gate support, shown in FIG. 5. Multiple anchors may be arranged in a variety of patterns, for example, to create a temporary corral.

Although this invention has been described above with reference to particular means, materials and embodiments, it is to be understood that the invention is not limited to these disclosed particulars, but extends instead to all equivalents within the scope of the following claims.

We claim:

1. A fencing anchor for placement on the ground for connection to fencing materials, the anchor comprising:

a. a block having a two generally vertical end surfaces, and having a bottom surface for contacting the ground, the bottom surface having two end edges at its horizontal extent and having a centerline between and generally parallel to the two end edges and generally parallel to the end surfaces, wherein the bottom surface meets said end surfaces at its said two end edges, and wherein the bottom surface extends upward from its two end edges to the centerline to make the bottom surface generally concave; and b. connection means attached to the two end surfaces for connecting fencing material to the two end surfaces for supporting a fence.

2. A fencing anchor as set forth in claim 1, wherein the bottom surface consists of two generally planar sections extending from their respective end edges and meeting at an angle at the centerline of the bottom surface.

3. A fencing anchor as set forth in claim 2, wherein the planar sections slant up from their respective end edges at 10–20 degrees above horizontal.

4. A fencing anchor as set forth in claim 1, further comprising a height-extending member rigidly attached to said block and extending above the block 4–8 feet.

5. A fencing anchor for connection to fencing materials comprising:

a. a block comprising a base having a front surface, back surface, two end surfaces, a bottom surface, and a top surface, and wherein the block has a long dimension between the two end surfaces and a wide dimension between the front surface and back surface, wherein the long dimension is greater than the wide dimension;

b. wherein the bottom surface has a center area, and has two end edges at junctions between the bottom surface and the two end surfaces, and the bottom surface near the end edges lies at an acute angle to the end surfaces; and c. the fencing anchor further comprising connection means attached to the two end surfaces for connecting fencing material to the block for supporting a fence.

6. A fencing anchor as in claim 5, wherein the bottom surface comprises two inwardly-facing slanted planar surfaces extending from the end edges and meeting near the bottom surface center area.

7. A fencing anchor as set forth in claim 6, wherein the planar surfaces slant up from their respective end edges at 10–20 degrees above horizontal.

8. A fencing anchor for connection to fencing materials, the anchor comprising:

a. a block for resting on the ground, the block having a bottom surface, a front surface, a back surface, first and second generally vertical end surfaces each having a width, and a longitudinal axis extending from said first end surface to said second end surface;

b. connection means attached to said first and second end surfaces for connecting fencing material to the block for supporting a fence;

c. wherein the bottom surface is generally concave and has a first and second end edge at its outer perimeter; and d. wherein said first and second end surfaces each have a bottom edge that is generally horizontal and continuous along the entire width of each of the first and second end surfaces, and wherein said first and second end surfaces meet the bottom surface along substantially their entire bottom edge.

9. A fencing anchor as in claim 8 wherein the bottom surface has a centerline and consists of first and second planar sections extending from the first and second end edges, respectively, and meeting at an angle at the centerline.

10. A fencing anchor as in claim 9, wherein said first and second planar sections extend up at about 10–20 degrees from horizontal.

* * * * *